United States Patent [19]

Cauchon et al.

[11] 4,338,721

[45] Jul. 13, 1982

[54] TINED UTENSIL

[76] Inventors: Dorothy O. Cauchon, 94 Prospect St., Belmont, Mass. 02178; Rudolph Muto, 24 Williams St., Andover, Mass. 01810

[21] Appl. No.: 99,635

[22] Filed: Dec. 3, 1979

Related U.S. Application Data

[63] Continuation of Ser. No. 965,942, Dec. 4, 1978, abandoned.

[51] Int. Cl.[3] ..... B26B 19/02

[52] U.S. Cl. ..... 30/322

[58] Field of Search ..... 30/322, 323, 324, 325

[56] References Cited

U.S. PATENT DOCUMENTS

| | | | |
|---|---|---|---|
| D. 25,384 | 4/1896 | Dazun | 30/322 |
| 1,751,853 | 3/1930 | Buck | 30/322 |
| 1,809,254 | 6/1931 | Smith | 30/322 |
| 2,404,495 | 7/1946 | Hallum | 30/322 |
| 2,607,988 | 8/1952 | Williams | 30/322 |
| 2,720,699 | 10/1955 | Boruvka | 30/322 |
| 3,742,840 | 7/1973 | Cogswell | 3 0/322 |

FOREIGN PATENT DOCUMENTS

| | | | |
|---|---|---|---|
| 195614 | 5/1938 | Switzerland | 30/322 |
| 17401 | of 1901 | United Kingdom | 30/322 |
| 260867 | 11/1926 | United Kingdom | 30/322 |

*Primary Examiner*—Stephen G. Kunin
*Assistant Examiner*—J. T. Zatarga
*Attorney, Agent, or Firm*—Pearson & Pearson

[57] ABSTRACT

A utensil such as a lobster fork, or lobster pick includes a handle and at least one tine having a plurality of substantially frustro-conical members end-to-end, each of progressively larger diameter from the first, or tip, member through the second member to a third member, the three members forming an enlarged barbed spear head at the end of each tine. The base of each member is dished and concave, the peripheral outer edge of each member is blunt and rounded and there are three elongated grooves spaced 120° apart extending along the tapered members of the spear head.

3 Claims, 7 Drawing Figures

TINED UTENSIL

RELATED APPLICATION

This is a continuation of application Ser. No. 965,942, filed Dec. 4, 1978, now abandoned.

BACKGROUND OF THE INVENTION

It has heretofore been proposed in U.S. Pat. No. 2,607,988 to Williams of Aug. 26, 1952 to provide a utensil, usable as a lobster form and lobster pick, wherein the tines are each provided with a plurality of substantially frustro-conical members tapering in the direction of the free ends of the tines and all of progressively smaller transverse dimensions in that direction.

However, a utensil of that type has not come into general use perhaps for the reason that the barbs tended to penetrate into the flesh but not to anchor themselves adequately for retraction out of the shell surrounding the flesh.

SUMMARY OF THE INVENTION

In this invention a plurality of substantially frustro-conical members tapering toward the terminal tip of each tine are used but they do not become progressively smaller in exterior dimensions as they approach the tip as in the Williams patent mentioned above.

Instead the three end tines form an enlarged spear head, so that if the frustro-conical members are numbered from one at the tip to two, three, four, five, etc. rearwardly toward the handle, No. 1 is of the smallest diameter, No. 2 is of greater diameter and No. 3 is of the greatest diameter to form the spear head. The remaining frustro-conical members four, five, six, etc. are preferably of the same exterior dimensions as No. 2.

In addition the tines of the invention have a dished, or concaved, base, they have a blunt, rounded, peripheral edge extending around the base so as not to unduly cut the flesh, the cross section of the frustro-conical members is preferably oval rather than circular and preferably there are three elongated grooves, spaced 120° apart, which extend along the circumferential surfaces of the set of frustro-conical members.

The lobster form utensil of the invention includes a pair of tines as specified above, each tine having a unique curved configuration toward the other and a unique upward curved configuration away from the handle. The tines of the invention are preferably each formed at one of the opposite ends of a single rod, or wire, bent back upon itself to form an elongated U shaped handle which may be encapsulated, or covered with a suitable material.

DESCRIPTION OF A PREFERRED EMBODIMENT

Figure 1:
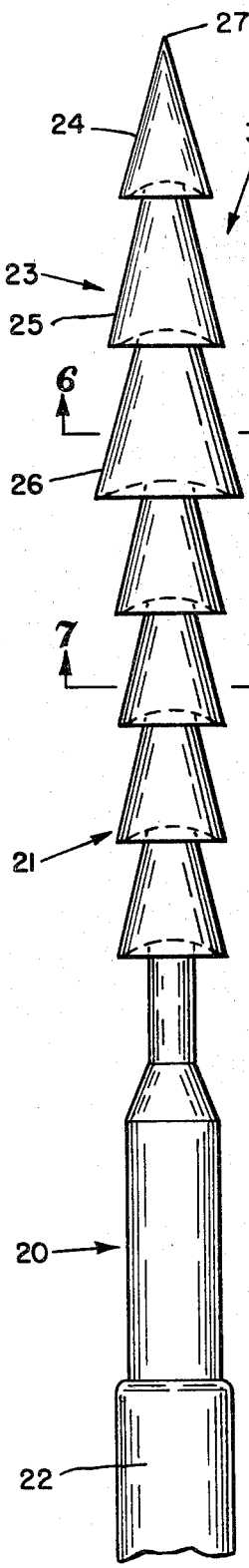
FIG. 1 is a fragmentary, plan view of a tine constructed in accordance with the invention, with an enlarged spear head, usable as a lobster pick or as one of a pair of tines of a fork.

The utensil 20 of the invention may be a straight lobster pick 21, as shown in FIG. 1, having a suitable handle 22 with a plurality of substantially frustro-conical members 1, 2, 3, 4, 5, 6, and 7 forming a tine 23 at the free, terminal, or distal, end thereof. The frustro-conical members may be of any desired number but are shown seven in number for convenience. They each have an outer, tapered, circumferential surface such as indicated at 24, 25, and 26 which tapers in the direction of the tip 27 of the tine 23.

Figure 2:
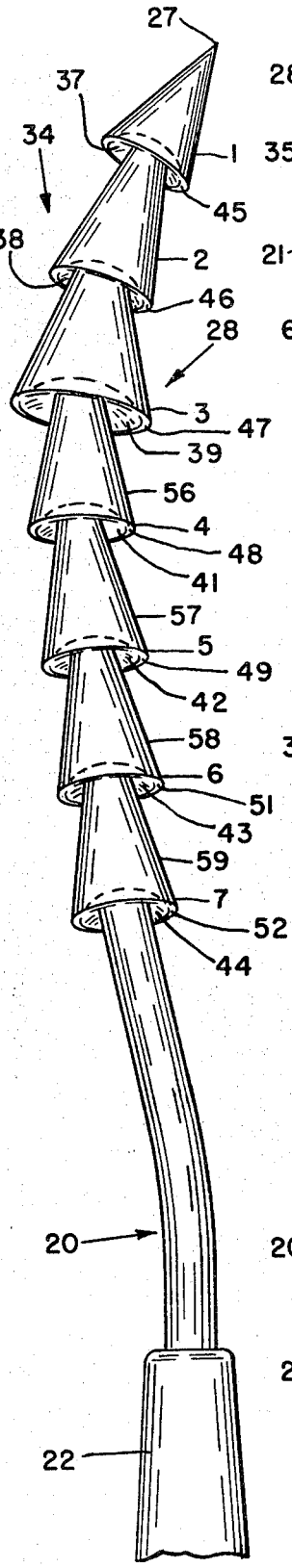
FIG. 2 is a fragmentary, side elevation of a tine constructed in accordance with the invention and forming one of a pair of tines of a lobster fork.

FIG. 2 shows a tine 28 similar to the tine 23, but curved to form one of a pair of tines 29 for a lobster fork 31, the other tine of the pair being designated 32.

It will be seen that the tines 23, 28 and 32 are all similar in configuration and differ from the utensil of the above-mentioned Williams patent in defining an enlarged "spear head" 33, 34, 35 or 36 at the end of the tines.

The frustro-conical member 1 of each tine, is of the smallest exterior dimensions, with a sharp pointed tip 27, the member 2 has a larger exterior dimension, or diameter, and the member 3 has an even larger exterior dimension, while the remaining frustro-conical members are preferably of the reduced exterior dimensions of member 2 as shown at 4, 5, 6 and 7.

The barbed, enlarged spear heads 33, 34, 35 and 36 thus easily penetrate the flesh of a lobster or other shell fish with the sharp point 27 in the lead. However, the base of each frustro-conical member of the tines is concave and dished as at 37, 38, 39, 41, 42 43 and 44 and the peripheral edges of each frustro-conical member of the tines is rounded and blunt as at 45, 46, 47, 48, 49, 51 and 52. Thus the flesh is not cut by a sharp edge, upon withdrawal, but instead, the blunt, enlarged peripheral edge 47 of frustro-conical member 3 of each tine secures a grip on the flesh and pulls it rearwardly as the pick or fork is withdrawn to expose an uncut, unfragmented delicious and attractive morsel.

Figure 6:
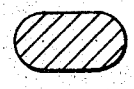
FIG. 6 is an enlarged view on section on line 6—6 of FIG. 1 showing the preferred oval cross section of the tines of the invention.
Figure 7:
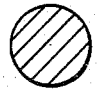
FIG. 7 is a view similar to FIG. 6 in section on line 7—7 of FIG. 1, showing that the frustro-conical members, in rear of the spear head may be circular in cross section.

While the frustro-conical members 4, 5, 6, and 7 may be of circular cross section as shown in FIG. 7, it is preferred that all of the members 1–7 be of oval cross section as shown in FIG. 6, because an oval cross section is more readily introduced into the cracks and pockets of the shell of a shell fish and has a spoon or spatular like effect in assisting in withdrawal of the flesh.

Figure 4:
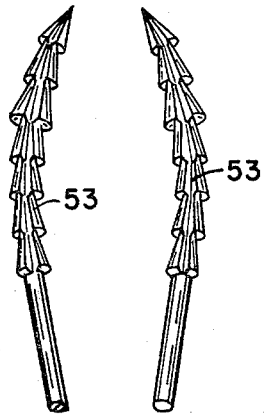
FIG. 4 is a fragmentary, plan view of the preferred form of the invention, showing the grooves in the frustro-conical members.
Figure 5:
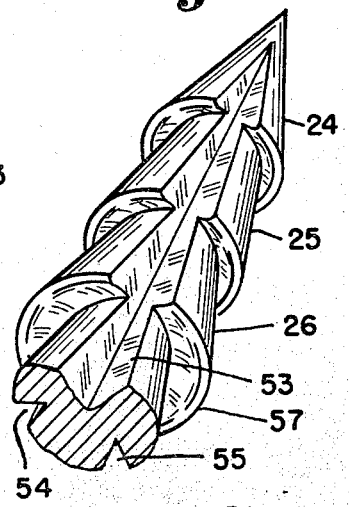
FIG. 5 is a fragmentary perspective view of an enlarged scale also showing the three grooves.

As best shown in FIGS. 4 and 5, it is also preferred that at least one elongated groove 53, and preferably three elongated grooves, 53, 54 and 55, spaced one hundred twenty degrees apart extend longitudinally along the tapered, circumferential faces such as 24, 25 and 26 of not only the spear heads 33, 34, 35 and 36 but also of the corresponding faces 56, 57, 58 and 59 of the remaining frustro-conical members.

Figure 3:
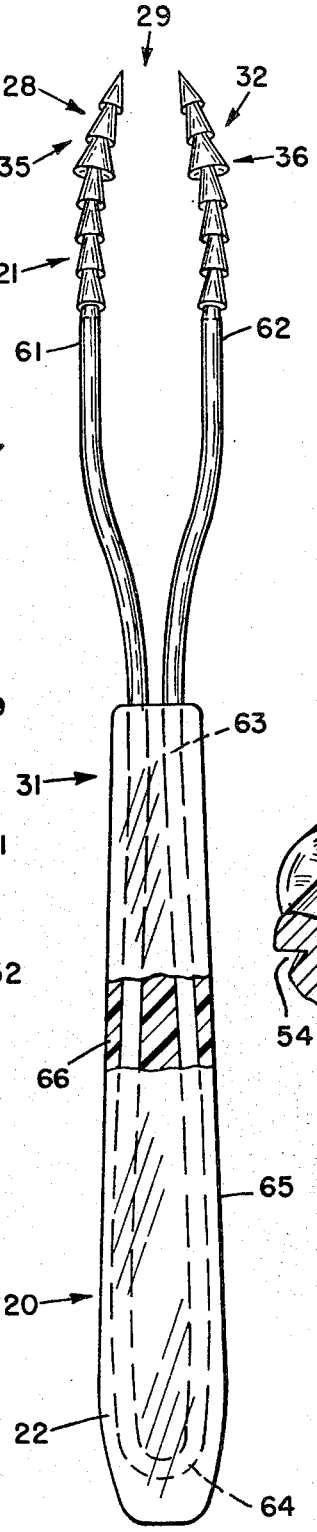
FIG. 3 is a plan view, on a reduced scale of a lobster fork of the invention.

It is also preferred that the pair 29 of tines 28 and 32 not only curve inwardly toward each other as shown in FIGS. 3 and 4 but also that they curve upwardly away from the handle 22 and then downwardly again to a tip 27 on a line in extension of the longitudinal centre line of the handle as shown in FIG. 2. This curve makes the fork more easy to handle and better able to penetrate the claws of shell fish such as lobster.

As also shown in FIG. 3, a preferred embodiment of the invention consists in forming the barbed, spear headed tines 28 and 32, each at an opposite end 61 or 62 of a single rod or wire 63 which may be of metal, plastic or other suitable materials. The rod, or wire, 63 is bent back upon itself at 64 in U shaped configuration to form a handle 65. A cover, or encapsulation 66 is provided over the U shaped portion 65 to form the handle 22 of the device.

I claim:

1. A utensil comprising:

an elongated handle having at one end at least one tine with a shank of predetermined diameter;

said tine having an enlarged spear head comprising a substantially conical free terminal tip and at least two substantially frustro-conical members, said members tapering, and having bases and peripheral edges of progressively larger diameter from said free terminal, substantially conical, tip rearwardly toward said shank of said tine;

the said frustro-conical member of said spear head nearest said shank, being of substantially greater diameter at the base than the diameter of the shank of said tine to form the base of said spear head;

each said frustro-conical member including a plurality of longitudinally extending grooves at spaced angular distances therearound, each groove extending rectilinearly and continuously along the tapered exterior surfaces of said members from proximate said tip to proximate the base of said spear head;

whereby said grooves are each aligned along said tine.

2. A utensil as specified in claim 1 wherein:

the said member forming the base of said spear head has a circular base which merges with the tapered frustro-conical outer face thereof in a blunt, rounded peripheral edge and said shank is of uniform predetermined diameter proximate said spear head.

3. A lobster fork comprising a handle having a pair of tines at one end thereof, each having a shank of predetermined diameter;

each said tine being formed by a substantially conical free terminal tip and a plurality of end-to-end, substantially frustro-conical, members of progressively greater diameter from the said free terminal tip thereof rearwardly, the frustro-conical member nearest to said shank and furthest removed from said free terminal tip being of substantially greater base diameter than the diameter of said shank to define an enlarged, spear head at the distal end of each tine;

each said spear head of each said tine including three longitudinally extending grooves, spaced one hundred twenty degrees apart therearound and each aligned and continuous along the exterior tapered faces of said substantially conical tip and of the frustro-conical members thereof.

* * * * *